US008172693B1

(12) United States Patent
Guerzini et al.

(10) Patent No.: US 8,172,693 B1
(45) Date of Patent: May 8, 2012

(54) PLAYSET SYSTEM COMPONENTS

(75) Inventors: Michael Guerzini, Newburgh, IN (US); Daniel Webb, Newburgh, IN (US); Gene Hunter, Raleigh, NC (US); Tom Ellingson, Raleigh, NC (US); Charles Louis Lasky, Grafton, WI (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 13/361,069

(22) Filed: Jan. 30, 2012

Related U.S. Application Data

(63) Continuation of application No. 13/089,717, filed on Apr. 19, 2011, which is a continuation of application No. 12/432,260, filed on Apr. 29, 2009, now Pat. No. 8,002,642.

(60) Provisional application No. 61/059,948, filed on Jun. 9, 2008.

(51) Int. Cl.
*A63G 21/00* (2006.01)
*A63B 9/00* (2006.01)

(52) U.S. Cl. ..... 472/116

(58) Field of Classification Search ..... 472/116–125, 472/128, 136; 52/79.6, 650.3, 87; 482/35–37
See application file for complete search history.

(56) References Cited

U.S. PATENT DOCUMENTS

| | | | | |
|---|---|---|---|---|
| 3,451,672 | A | 6/1969 | Kazdan | |
| 3,579,395 | A | 5/1971 | Rath | |
| 3,798,103 | A | 3/1974 | Gaunt | |
| 4,262,900 | A | 4/1981 | Vinson | |
| 4,484,739 | A | 11/1984 | Kreinbihl et al. | |
| D340,273 | S | 10/1993 | Ezell | |
| 5,554,074 | A | 9/1996 | Von Parrish | |
| 5,741,189 | A | 4/1998 | Briggs | |
| 5,865,680 | A | 2/1999 | Briggs | |
| 5,946,756 | A | 9/1999 | Mapp | |
| 6,165,106 | A | 12/2000 | McBride et al. | |
| 6,209,267 | B1 | 4/2001 | Dantzer | |
| 6,210,287 | B1 * | 4/2001 | Briggs | 472/128 |
| 6,264,202 | B1 * | 7/2001 | Briggs | 273/394 |
| 6,342,015 | B1 | 1/2002 | Robertson et al. | |
| 6,361,445 | B1 | 3/2002 | Zeilinger | |
| 6,372,176 | B1 | 4/2002 | Ekendahl et al. | |
| 6,786,830 | B2 | 9/2004 | Briggs et al. | |
| 2004/0145092 | A1 | 7/2004 | McCollum et al. | |
| 2004/0146714 | A1 | 7/2004 | McCollum et al. | |

OTHER PUBLICATIONS

Rainbow Play Systems, Inc. Design Book 2008 Catalog, pp. 98 and 121.

* cited by examiner

*Primary Examiner* — Kien Nguyen
(74) *Attorney, Agent, or Firm* — Woodard, Emhardt, Moriarty, McNett & Henry LLP

(57) ABSTRACT

Many playsets include one or more tower sections with one or more platform sections supported above the ground or a similar support surface with a support structure or framing. In certain embodiments, a curved wall portion defines one or more panel openings. Subpanels may optionally be mounted into the openings. A balcony floor protrudes outwards with a curved outer edge or face with an interior flat floor edge adjoining an edge of a polygonal platform section floor to enlarge the square footage of the floor area of the platform section.

20 Claims, 23 Drawing Sheets

PLAYSET SYSTEM COMPONENTS

CROSS-REFERENCE TO RELATED APPLICATION

This application is a continuation of U.S. patent application Ser. No. 13/089,717 filed Apr. 19, 2011 which is a continuation of U.S. patent application Ser. No. 12/432,260 filed Apr. 29, 2009, now U.S. Pat. No. 8,002,642, which claims the benefit of U.S. Provisional Application Ser. No. 61/059,948, filed Jun. 9, 2008, all of which are hereby incorporated by reference in their entirety.

FIELD OF THE INVENTION

Aspects of the present disclosure relate to playsets and components.

BACKGROUND OF THE INVENTION

A common activity for children at residential, commercial or institutional locations is a playground arrangement. Such locations often include climbing equipment and related playset structures and often include one or more slides, swings, platforms, gliders, climbing walls, climbing bars and accessories for use by children playing on the playset. Aspects of the present disclosure address certain playset systems and features.

SUMMARY OF THE INVENTION

Figure 1:
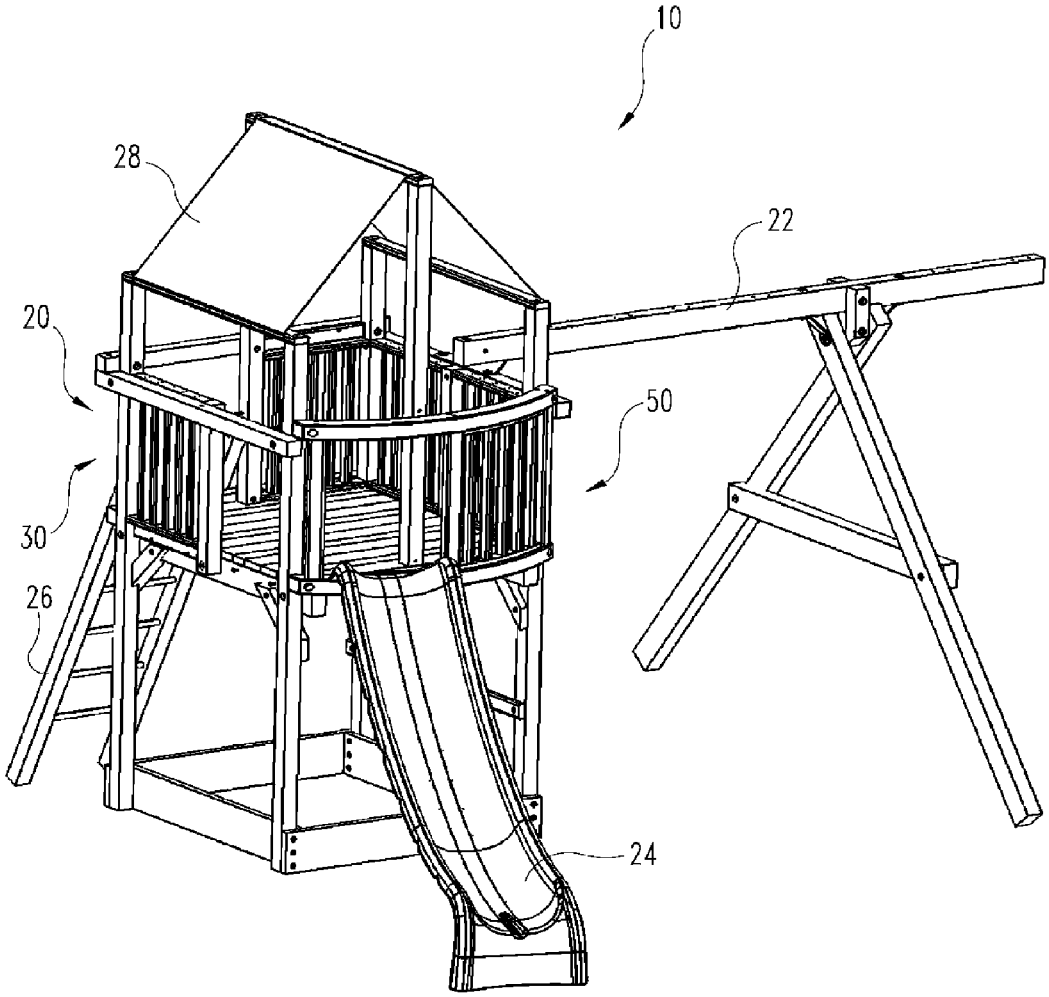
FIG. 1 is a perspective view of a playset structure according to certain embodiments.

The present disclosure includes certain embodiments for playset systems and components. Many playsets include one or more tower sections with one or more platform sections supported above the ground or a similar support surface with a support structure or framing. In certain embodiments, a curved wall portion defines one or more panel openings. Subpanels may optionally be mounted into the openings. A balcony floor protrudes outwards with a curved outer edge or face with an interior flat floor edge adjoining an edge of a polygonal platform section floor to enlarge the square footage of the floor area of the platform section.

One preferred embodiment of the present disclosure comprises a playset system which includes at least one tower section and at least one platform section supported by the support structure of the tower section. The platform section has a floor and exterior walls which define an interior area and a balcony section is formed in at least one of the exterior walls. The balcony section has a curved wall framing section protruding horizontally outward from the interior area along an arcuate curve. Additionally, the balcony floor section extends outward from the platform section floor to the curved wall framing section, wherein the balcony floor section has an outer edge defining an arcuate curve corresponding to the arcuate curve of the wall framing section.

In on embodiment, a playset system comprises at least one tower section and at least one platform section supported by the tower section above a support surface. The platform section has a floor and exterior walls defining an interior area. A balcony section forms at least a portion of the width at least one of the exterior walls where the exterior wall is formed with a curved wall framing section protruding horizontally outward from the interior area and defining an outward arcuate curve. In certain embodiments, the balcony section defines two balcony wall openings with at least one subpanel mounted in one of the balcony wall openings. The subpanel protrudes horizontally outward from the interior area along an arcuate curve. A balcony floor section extends outward from the interior area to the curved wall framing section. The balcony floor section has an outer edge defining an outward arcuate curve corresponding to the arcuate curve of the wall framing section.

Further objects, features and advantages of the present invention shall become apparent from the detailed drawings and descriptions provided herein. Each embodiment described herein is not intended to address every object described herein, and each embodiment does not include each feature described. Some or all of these features may be present in the corresponding independent or dependent claims, but should not be construed to be a limitation unless expressly recited in a particular claim.

DESCRIPTION OF THE ILLUSTRATED EMBODIMENTS

For the purposes of promoting an understanding of the principles of the disclosure, reference will now be made to the embodiments illustrated in the drawings and specific language will be used to describe the same. It will nevertheless be understood that no limitation of the scope of the claims is thereby intended, such alterations and further modifications in the illustrated device, and such further applications of the principles of the disclosure as illustrated therein, being contemplated as would normally occur to one skilled in the art to which the disclosure relates.

The present disclosure includes certain embodiments for playset systems and components. Playground equipment such as playsets, swing sets and climbing equipment are broadly referred to as playsets herein.

Certain preferred embodiments of a playset system 10 are illustrated in FIG. 1. An example playset may include one or more tower sections 20 connected to various accessories.

Common accessories include a swing arm assembly 22 from which hanging accessories such as swings, buoy balls, rings or rope swings can be suspended, slides such as slide 24, ladder 26, roof 28 or accessories such as monkey bars, fire poles, climbing walls, wheels, telescopes, etc. Playset 10 is illustrated as a non-limiting example configuration.

Figure 2:
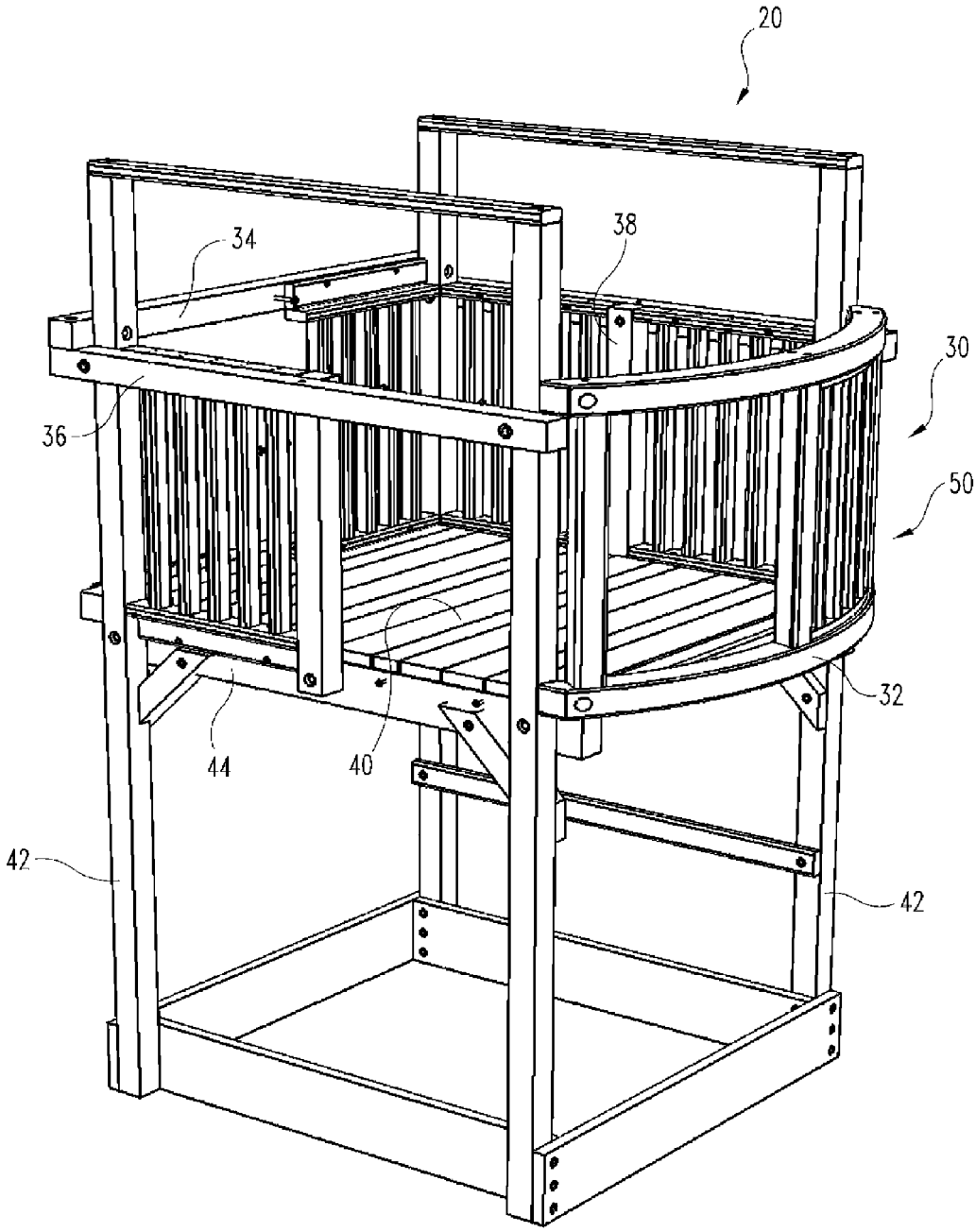
FIG. 2 is a perspective view of the tower portion of the playset structure of FIG. 1.
Figure 12:
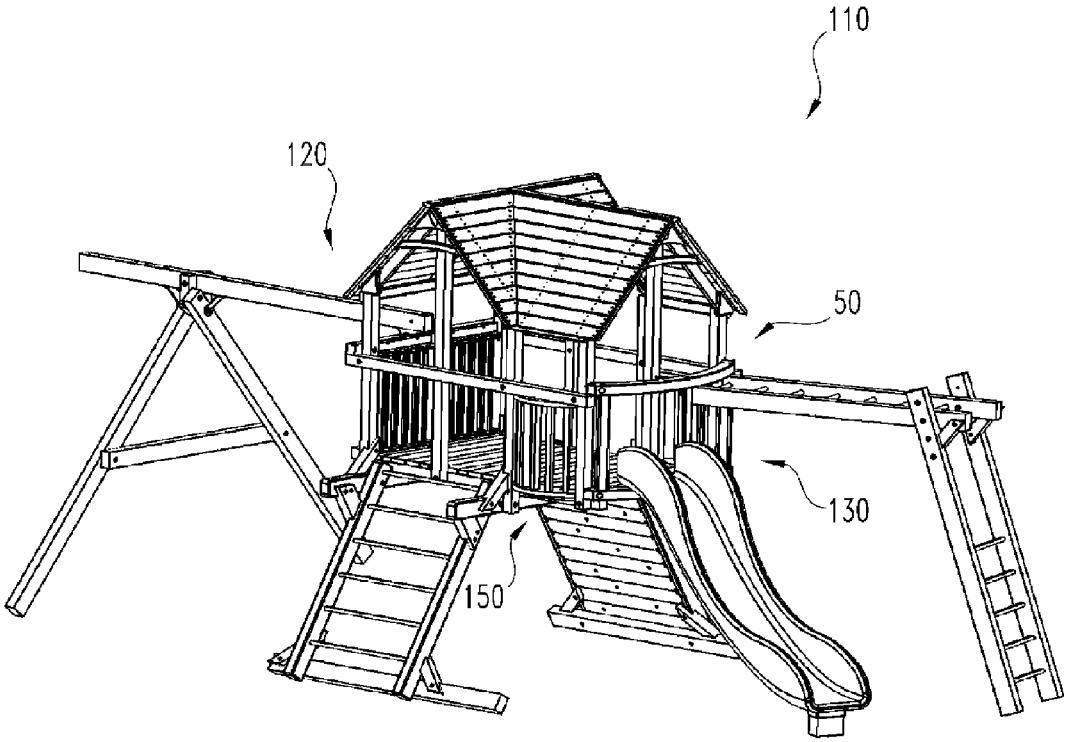
FIG. 12 is a perspective view of a playset structure according to certain embodiments.

Many playsets include one or more tower sections, such as tower section 20 shown in FIG. 2, with one or more platform sections supported above the ground or a similar support surface with a support structure or framing using uprights 42, cross beams 44 and appropriate bracing and fasteners. In one common configuration, a tower arrangement has substantially vertical uprights with a square base as shown in FIG. 1. In an alternate common configuration a lower section has angled supports extending from the support surface to a platform level to allow greater access underneath the platform section, as shown in FIG. 12. As desired, the platform section 30 may be supported at a height determined by the length, angle and mounting position of the uprights and cross beams with example platform deck heights between 65 inches and 84 inches. Different heights or multiple platforms with staggered deck heights may also be used as desired.

In the illustration shown, platform section 30 includes a floor and exterior walls defining an interior area, such as front wall 32, rear wall 34, left side wall 36, right side wall 38 and floor 40. References to front, rear, left, right, inward, outward, up and down herein are for convenience of illustration only and are not intended to be limiting. Typical platform sections are polygonal, such as rectangular, with flat edges or sides. In certain embodiments, one or more platform walls include cross beams and vertical balusters or spindles to function as a full width or partial width railings. Optionally, subpanels with balusters may be mounted or not used in portions of the wall sections to provide closed or open wall portions. Open portions are commonly used, for example, to allow access to the upper portions of accessories such as slides, fire poles and ladders. In many embodiments, the wall sections can be custom configured during installation to allow front, rear and side accessories to be mounted in desired locations.

In the embodiment illustrated in FIGS. 1 and 2, a protruding balcony section 50 is illustrated forming the front wall portion of platform section 30. Balcony section 50 includes an arcuatly protruding face from the interior area. Balcony section 50 is illustrated on the front for ease of reference and can alternately be mounted on any side or partial side of the platform section.

Figure 3:
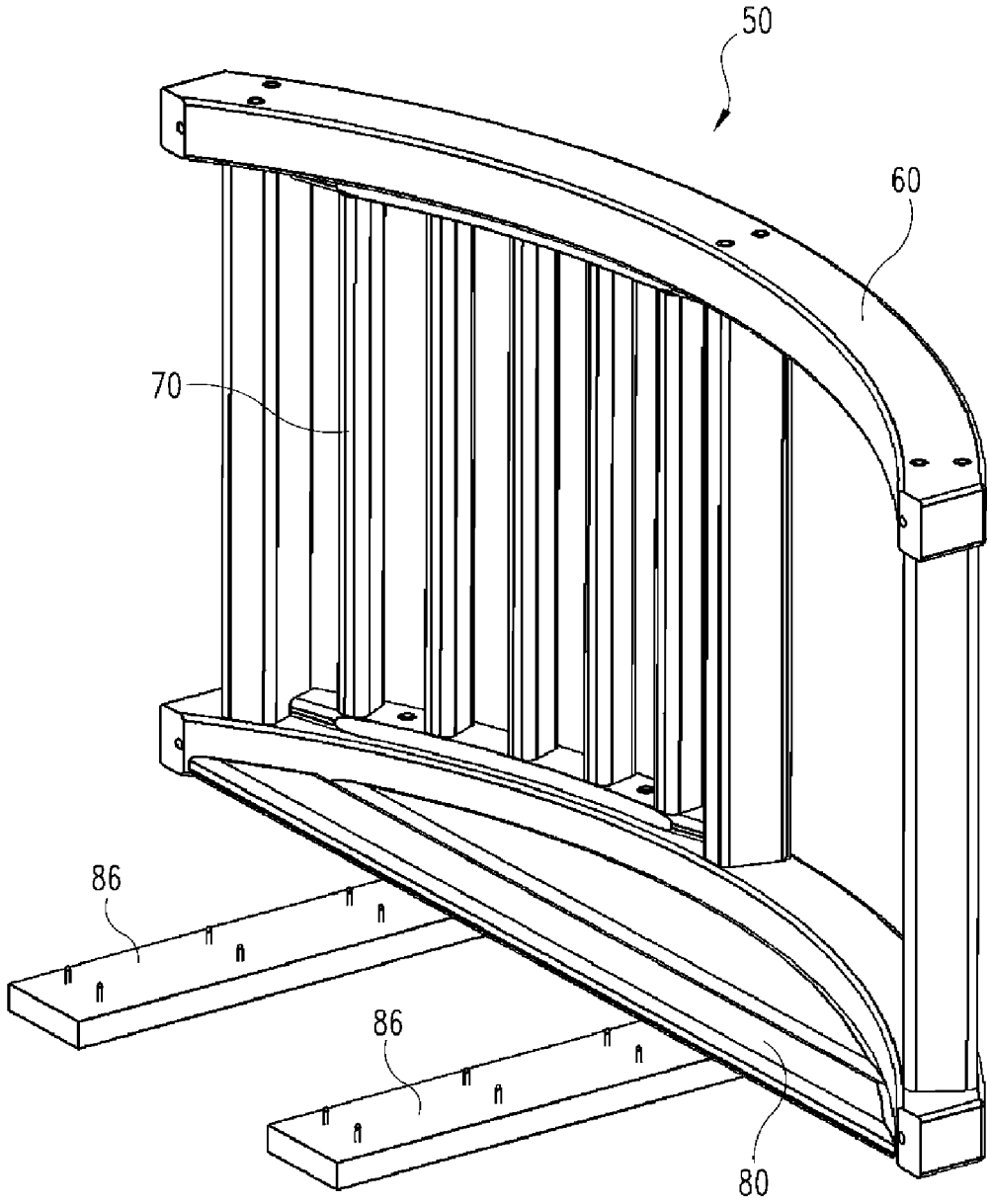
FIG. 3 is a perspective view of the balcony section of the playset structure of FIG. 1.
Figure 4:
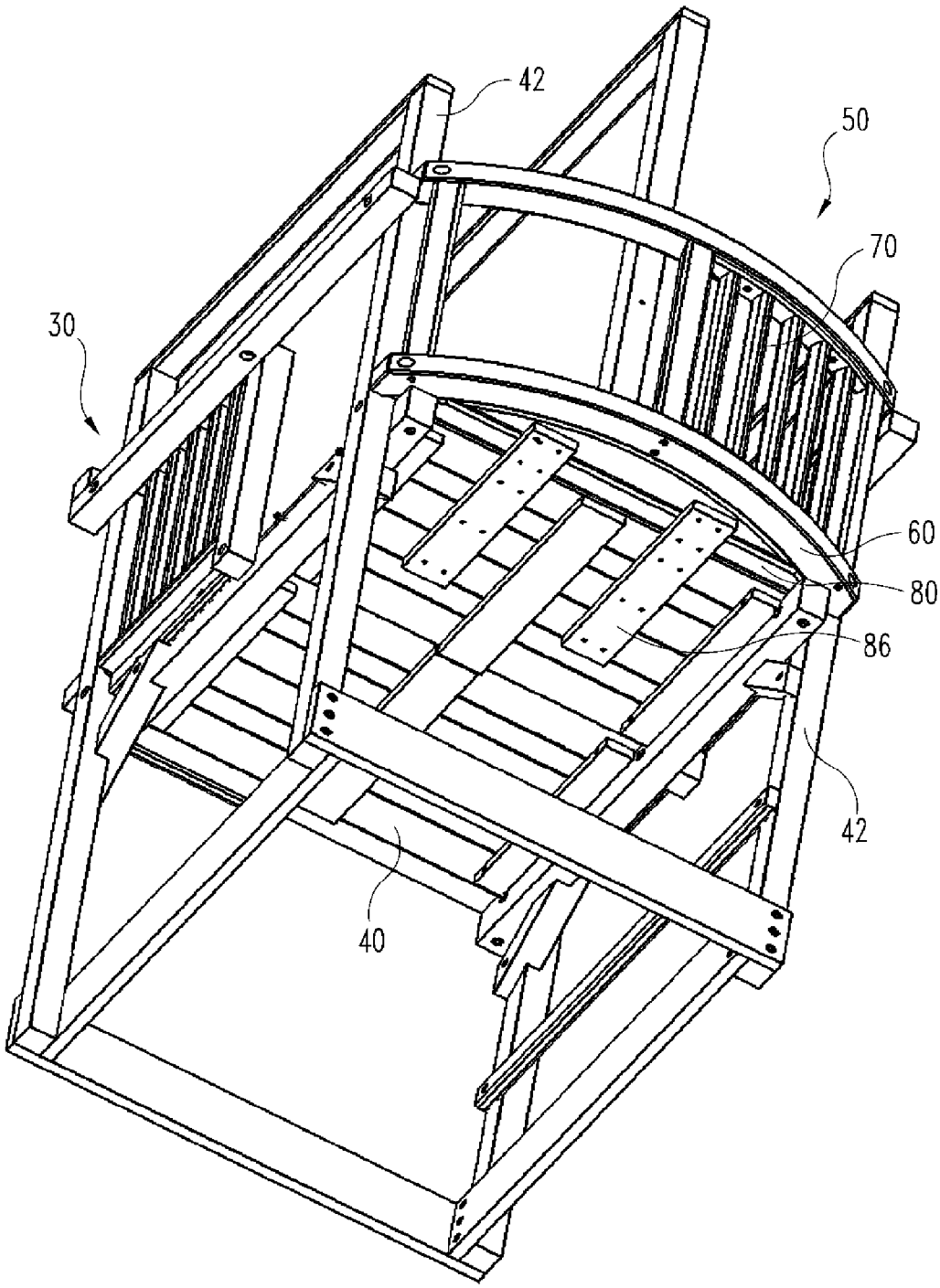
FIG. 4 is a lower perspective view of the playset structure of FIG. 1.

A perspective view of balcony section 50 is illustrated in FIG. 3. Generally, balcony section 50 includes outwardly curved wall framing section 60, curved subpanels 70 and a balcony floor 80. Support beams 86 may be used to mount all or portions of balcony section 50 to platform section 30. A lower perspective view of balcony section 50 with floor 80 mounted to platform section 30 using support beams 86 is shown in FIG. 4.

Preferably, curved framing portion 60 forms a wall of the balcony section. The framing portion 60 is mounted to the support structure for tower 20, such as by being bolted to uprights 42, and balcony floor 80 is connected to and supported by the floor 40 of platform section 30. Alternately, balcony floor 80 can be arranged to be directly connected to and supported by the wall portions or by the platform or tower support structure. Balcony floor 80 preferably protrudes outwards with a curved outer edge or face with an interior flat floor edge adjoining an edge of a polygonal platform section floor to enlarge the square footage of the floor area of the platform section.

Figure 5:
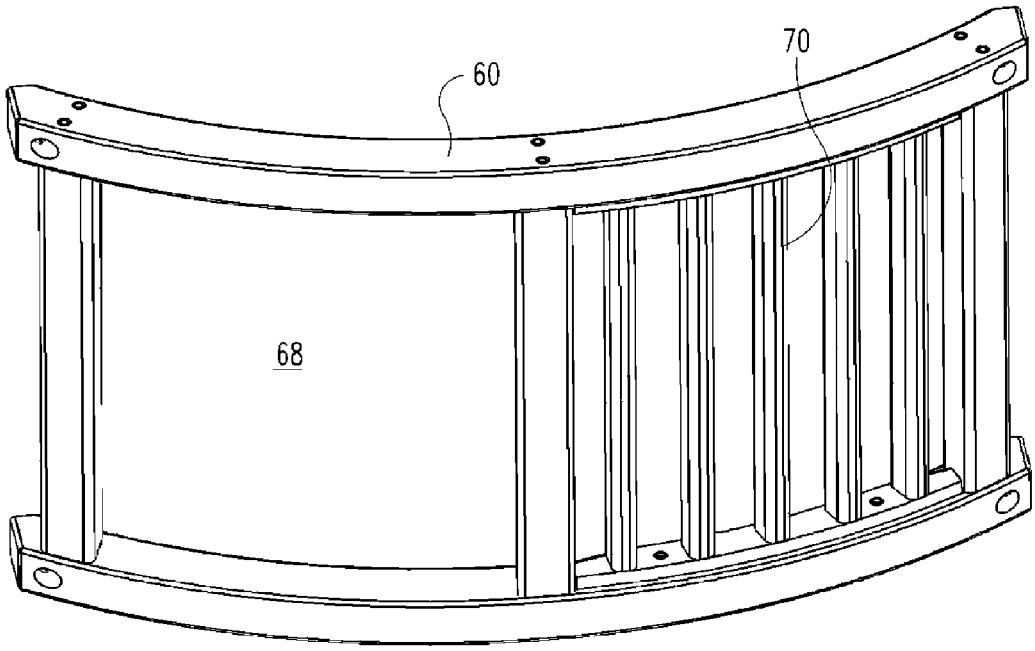
FIGS. 5-8 are views of the curved wall portions of the balcony section of FIG. 3.
Figure 6:
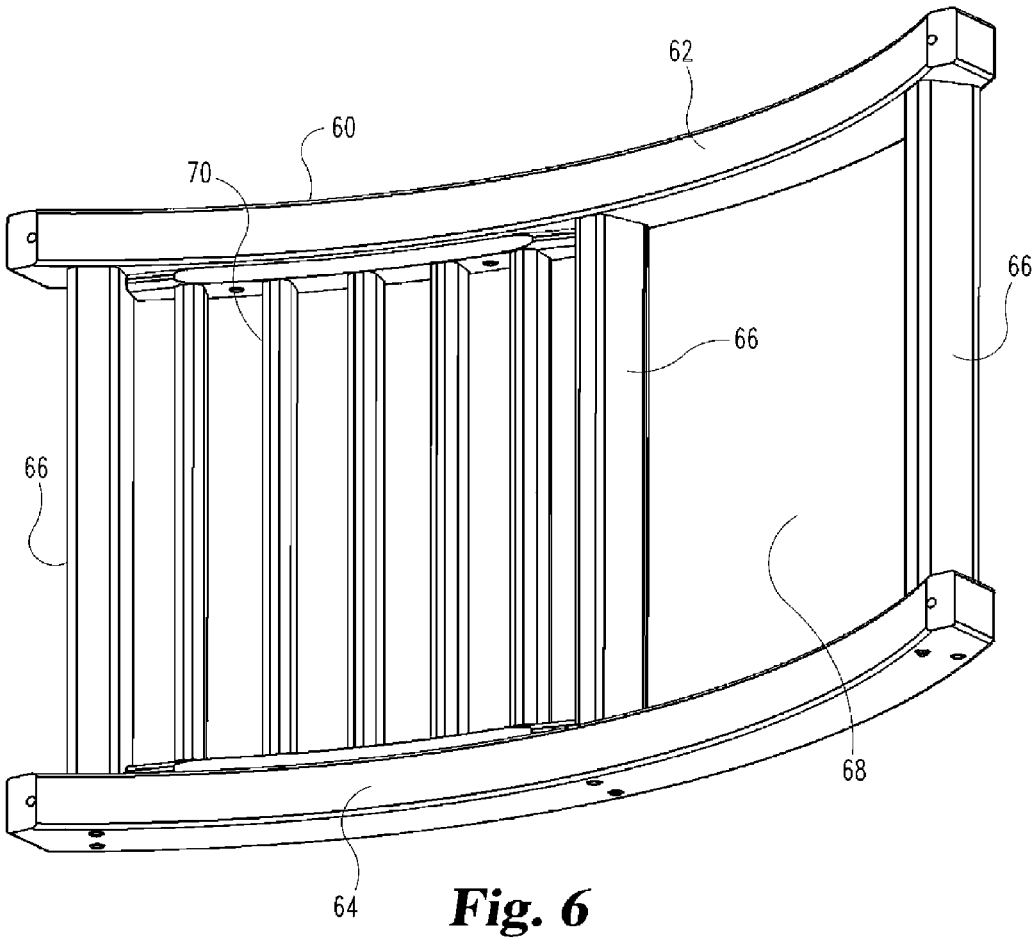
Figure 7:
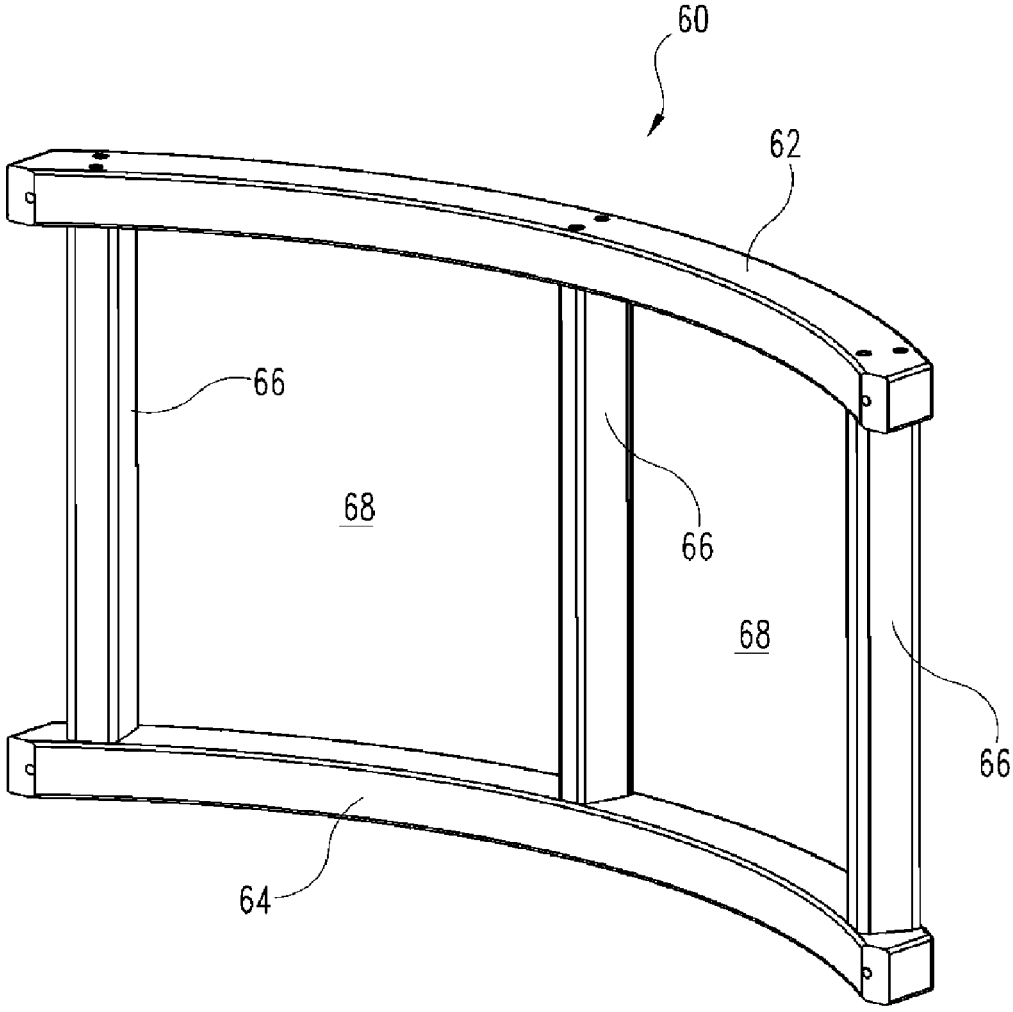

FIGS. 5 and 6 illustrate perspective views of the curved wall framing portion 60 of the balcony section and curved subpanel assemblies 70. As illustrated in additional detail in FIGS. 6-8, framing portion 60 of the balcony section includes a curved header beam 62 and a curved footer beam 64 which preferably are attached at their opposing ends to the tower's structure, such as uprights 42, for support with the curve protruding horizontally outward from the platform section. Preferably header beam 62 and footer beam 64 have inner and outer faces arcuately curved along corresponding radii for all or a portion of their length.

Curved header beam 62 is spaced above curved footer beam 64 to define the height of the balcony section wall. Framing posts 66 are mounted between the curved header and curved footer beams. In certain embodiments, one or more balusters or spindles are mounted between the header and footer and parallel to posts 66 along the width to define a protruding barrier face of the railing. The balusters may be connected to the inside faces, outside faces or between opposing upper and lower faces of the header and footer beams. The balusters may be fixed or removable.

Figure 8:
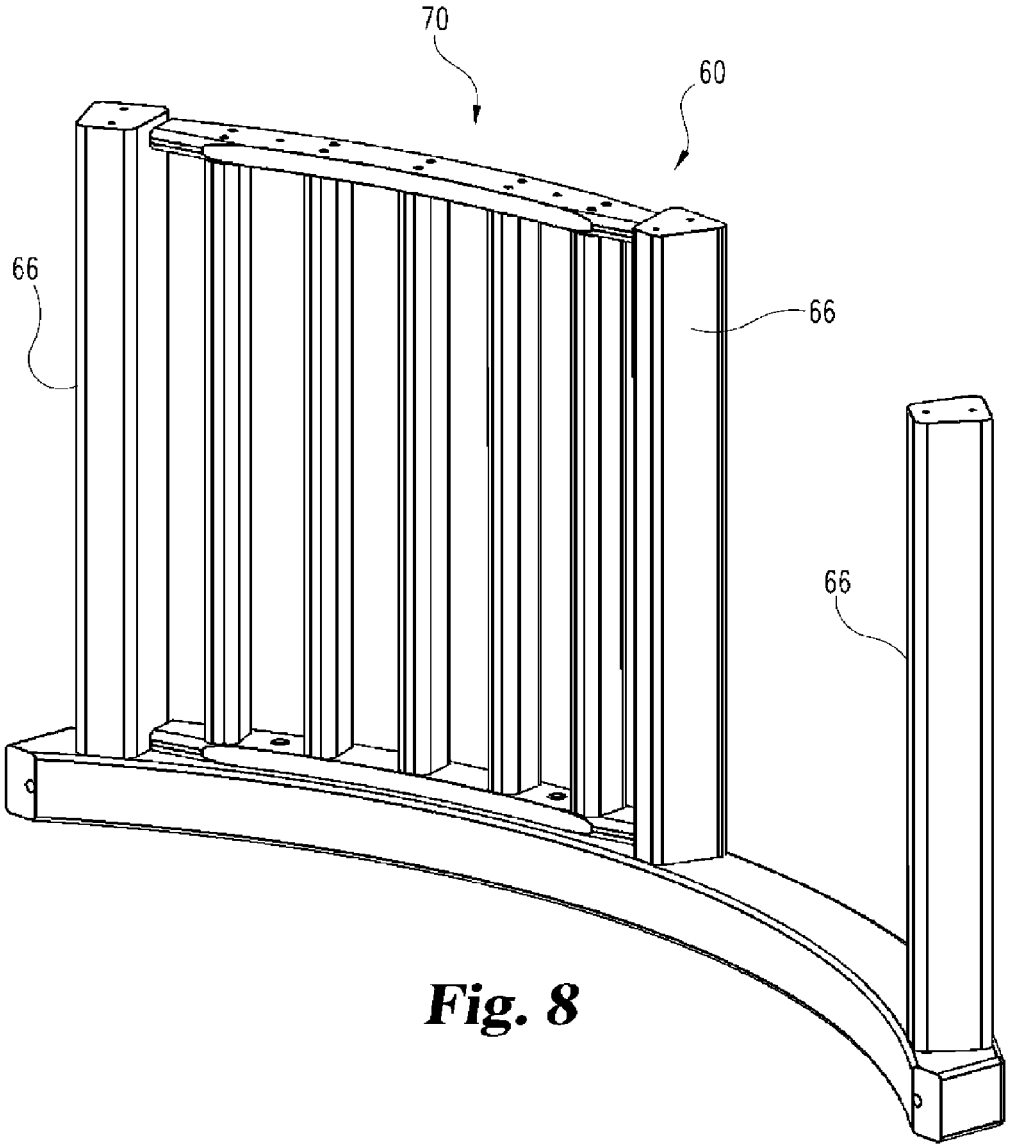

In certain embodiments, curved wall portion 60 defines one or more panel openings 68. Subpanels 70 may optionally be mounted into openings 68. Subpanels may be solid or open or may include balusters or spindles as barriers. Alternate barriers may be a curved sheet panel, multiple sheet panel portions, a lattice panel or netting. To accommodate insertion and mounting of each subpanel 70, framing posts 66 may optionally be tapered along their cross-sectional height along one or more sides as illustrated in FIG. 8 with trapezoidal cross-sections.

Panel openings 68 in the balcony wall allow accessories to be mounted to or adjacent the balcony section if desired. Non-limiting example accessories for such openings include slides, ladders, ramps and climbing walls. Such accessories may optionally be mounted perpendicular to a line which is drawn at a tangent with respect to the curve of the wall section along the opening 68. The mounted accessory, for example a slide, can thus extend at an angle from the playset which differs from the perpendicular direction in which such an accessory normally extends from a flat or straight edge of a polygonal platform. In certain embodiments this allows divergent or convergent accessories. For example, side-by-side accessories, such as two slides, may be adjacent at their tops, but diverge downward to spaced apart lower ends. Alternately one accessory, such as a climbing net could lead to two openings. In certain embodiments, the angle of mounting of the accessory to the curved wall can be adjusted as desired during mounting within a range defined by tangent lines to various points along the curve.

Figure 9:
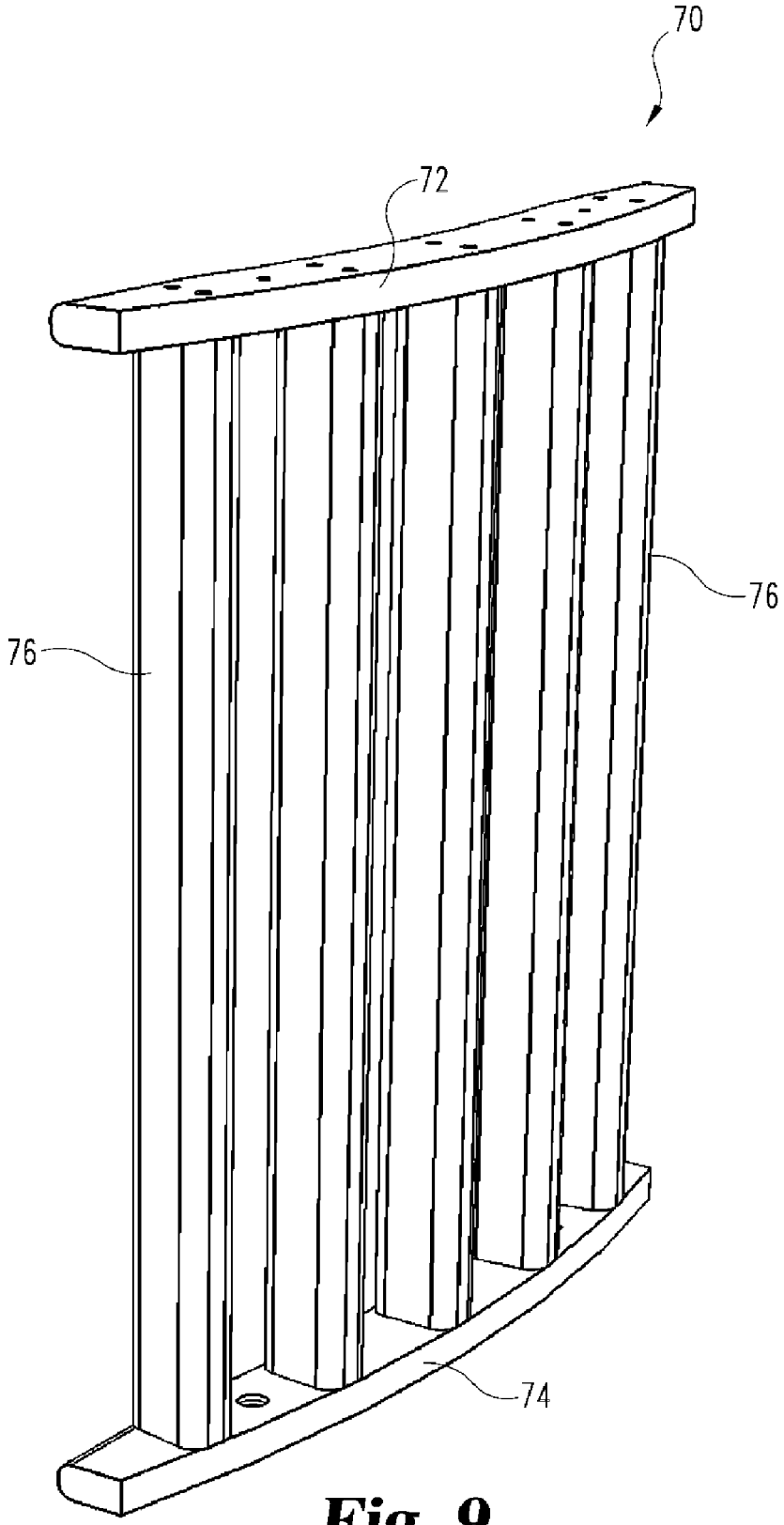
FIGS. 9 and 10 are views of the curved panel portions of the balcony sections of FIG. 3.
Figure 10:
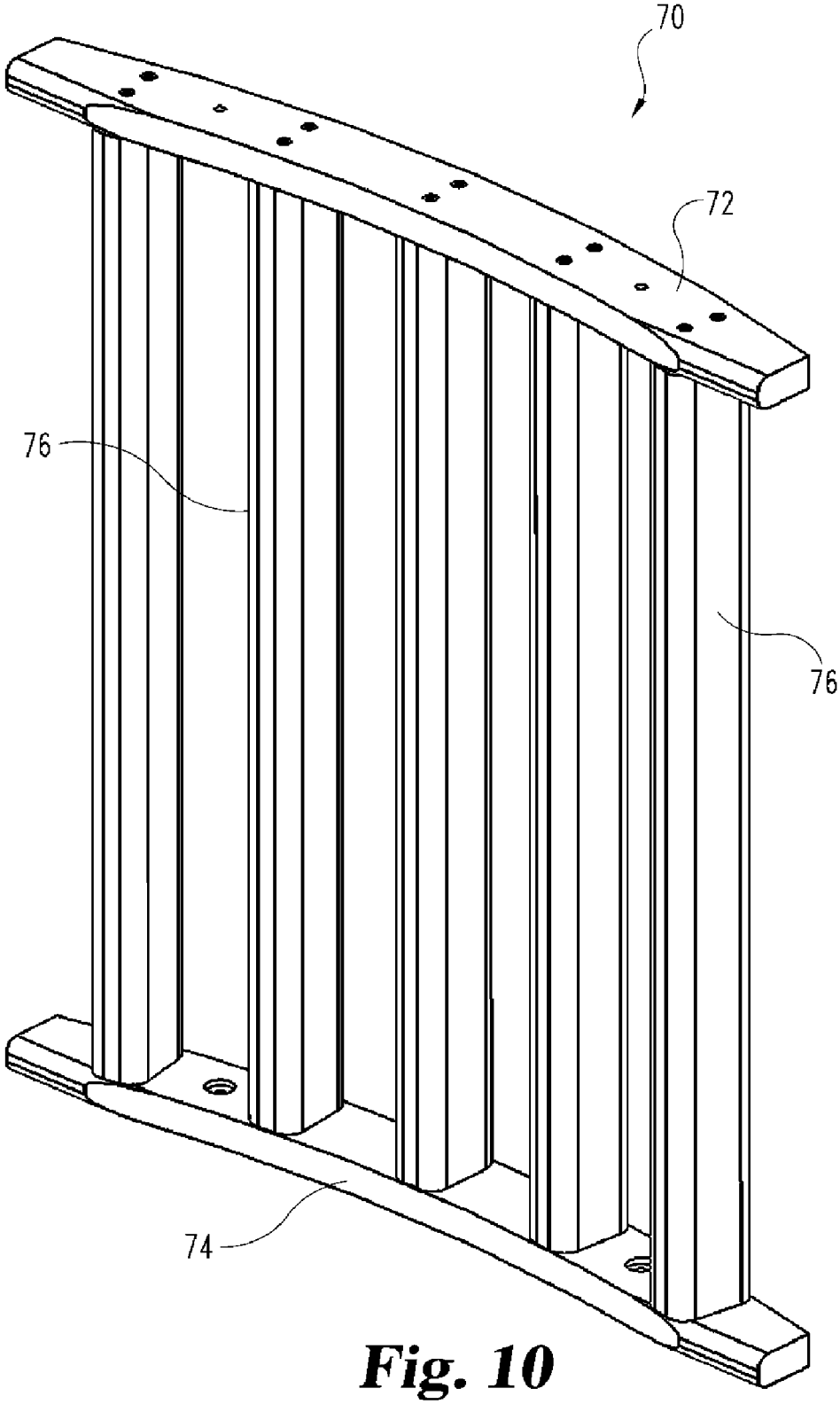

Perspective views of a curved subpanel assembly 70 are illustrated in FIGS. 9 and 10. Subpanel assembly 70 preferably includes a header 72, a footer 74 and one or more balusters or spindles 76 forming a barrier. The balusters or spindles 76 are typically arranged in parallel on the inside, outside or between the header and footer to define the height of the subpanel assembly. Balusters may be spaced as desired, although spacings are preferably evenly distributed and within safety codes. Alternately, a barrier formed with a solid or decorative sheet panel piece, multiple sheet pieces, a lattice work, a net or other pieces could be used.

Each subpanel assembly 70 is preferably designed and sized to fit within a balcony wall opening 68. As shown, each subpanel header 72 would typically be arranged below, and preferably closely adjacent or contacting the lower face of header beam 62 while subpanel footer 74 rests on the upper face of footer beam 64. In certain embodiments, header 72 and footer 74 have inner and outer curved faces with radii that fit between the inner and outer curves of the wall curved head and footer beams. Alternately, the subpanel header and footer may be mounted to the interior or exterior faces of the header and footer beams. The width of header 72 and footer 74 preferably fits between adjacent wall posts 66. The location of subpanels 70 is typically chosen during assembly of the playset and then the subpanel is fixedly, although optionally removably, mounted to the curved wall section 60 using screws, bolts, nails and other fasteners as desired.

Figure 11:
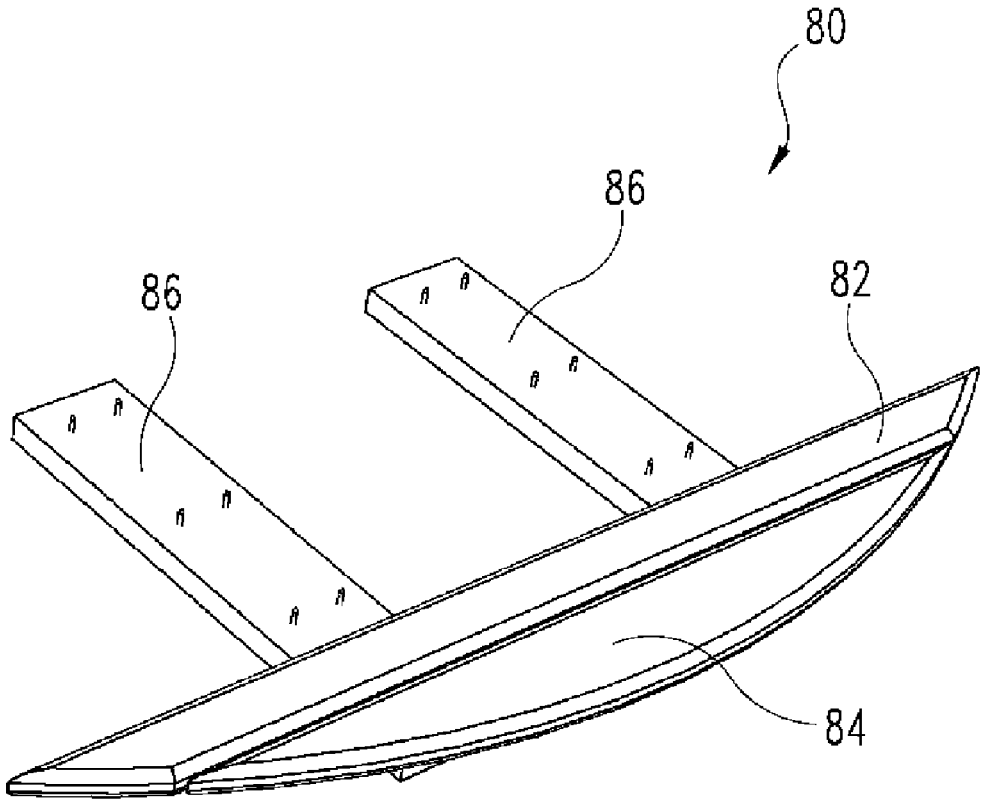
FIG. 11 is a perspective view of the floor portion of the balcony section of FIG. 3.

Balcony floor section 80 is illustrated in a perspective view in FIG. 11. In the example shown, balcony floor 80 includes one or more deck boards 82 which may be arranged in parallel and which are defined with arcuately curved ends. The top of balcony floor 80 is preferably level with the top of platform floor 40 to expand the square footage of the floor space. Alternately, the balcony section may be mounted with a floor arranged a step up or down from the platform floor.

An end board 84 is typically the outermost board on the floor and preferably includes an arcuate curve along all or much of its length corresponding to an inside, outside or middle curve of the curved wall portions. Preferably the opposing ends of one or more deck boards 82 are aligned and shaped to continue the curve defined by end board 84. As shown in FIG. 3, the outer curve of end board 84 may be sized to closely fit within the inner curve of footer beam 64. In this arrangement, the outer face of end board 64 is arranged in close proximity to, and optionally touching, the inner face of footer beam 64. Floor section 80 and wall section may not be directly connected to each other. Alternately, end boards may extend all or partially under a footer beam of the wall, or may all or partially rest on a top face of a footer beam.

Support elements such as support beams 86 preferably extend under deck boards 82 and end board 84. AS shown, one end portion of beams 86 supports floor 80 while the opposite end portions of the support beams extending below and connect to other elements of tower 20 such as floor 40. Support beams 86 are preferably mounted to the tower structure to securely support balcony floor 80 in use. Alternately, the floor boards may be mounted to footer beam 64, to other types of support beams or to the tower support structure.

An alternate example playset 110 is illustrated in FIG. 12 with example accessories of a swing arm assembly, monkey bars and a slide. Angled lower sections of a tower assembly 120 serve as supports for a platform section 130 and also may provide access to the platform section by serving as ladders, climbing walls or similar accessories. Tower section 120 is shown in further detail in FIGS. 13 and 14 including platform section 130. As illustrated, platform section 130 includes a balcony section 50 along one wall and a balcony section as a partial protruding wall portion 150 along a different wall. Platform section 130 includes floor 140 and is supported by a framework of uprights 142, cross rails 146 and support beams 144. Balcony section 50 and protruding wall portion 150 are preferably mounted to a framework of platform section 130, for example as shown in FIGS. 15-18.

Figure 13:
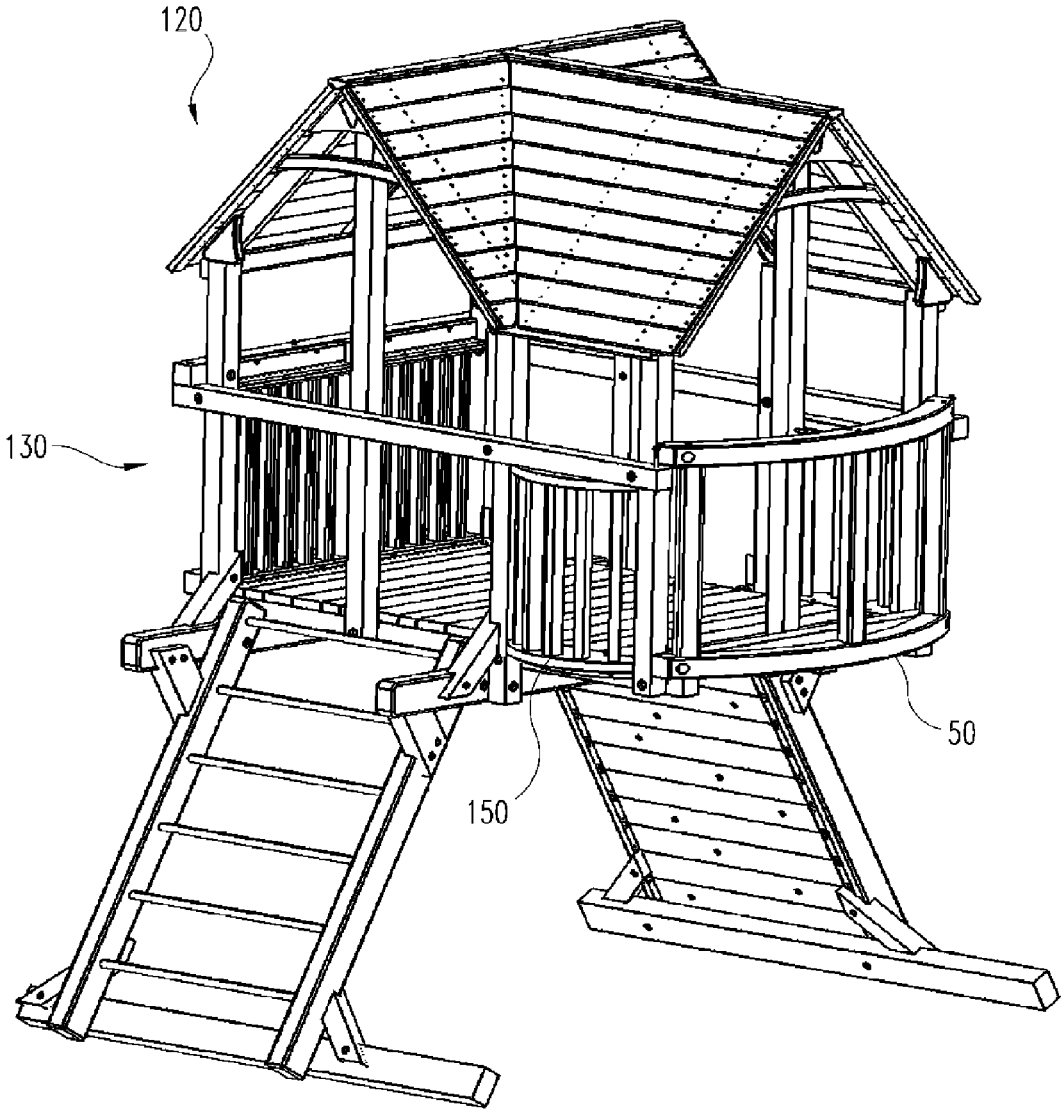
FIG. 13 is a perspective view of the tower portion of the playset structure of FIG. 12.
Figure 14:
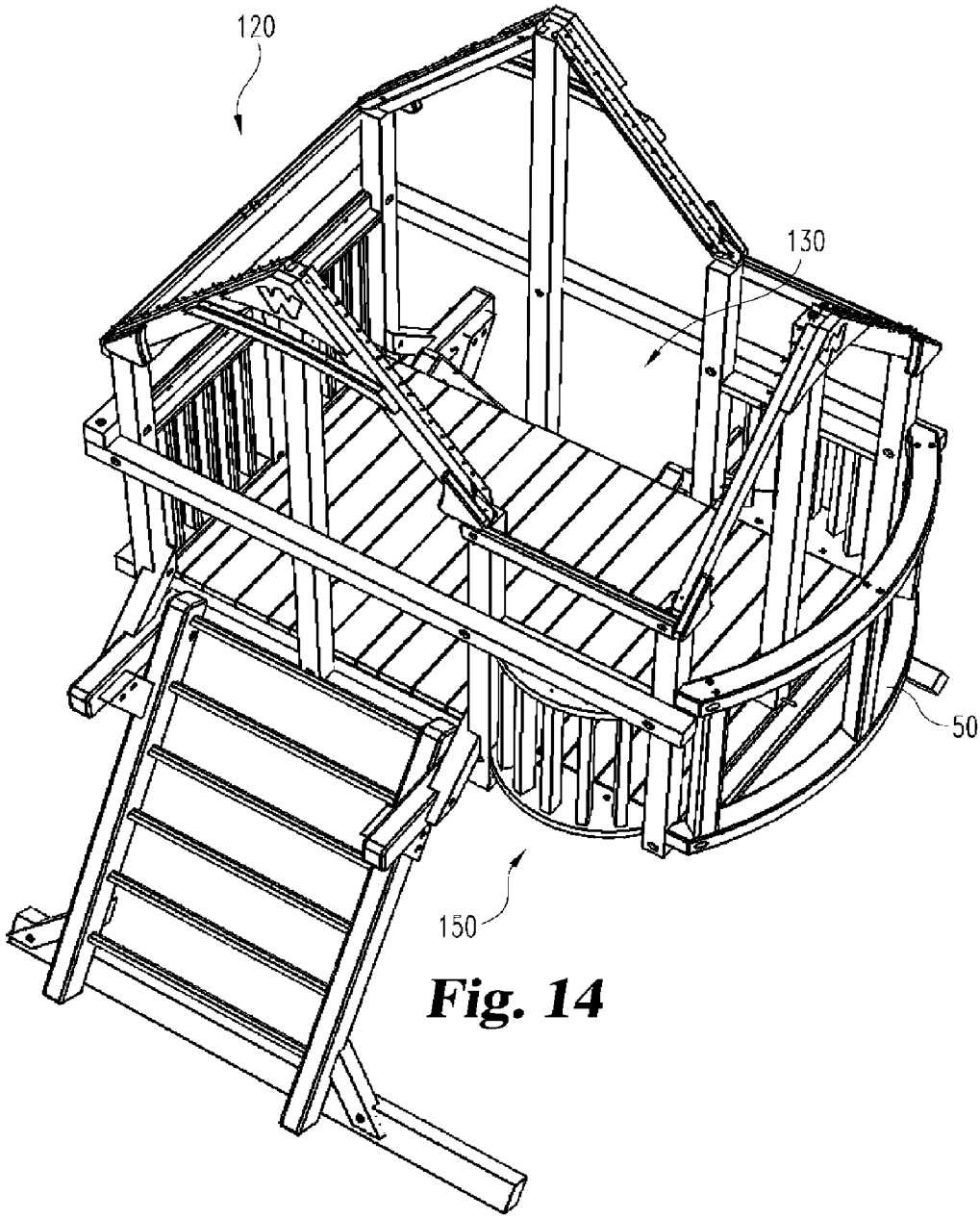
FIG. 14 is a perspective downward view of the tower portion of the playset structure of FIG. 13 without the roof section.
Figure 15:
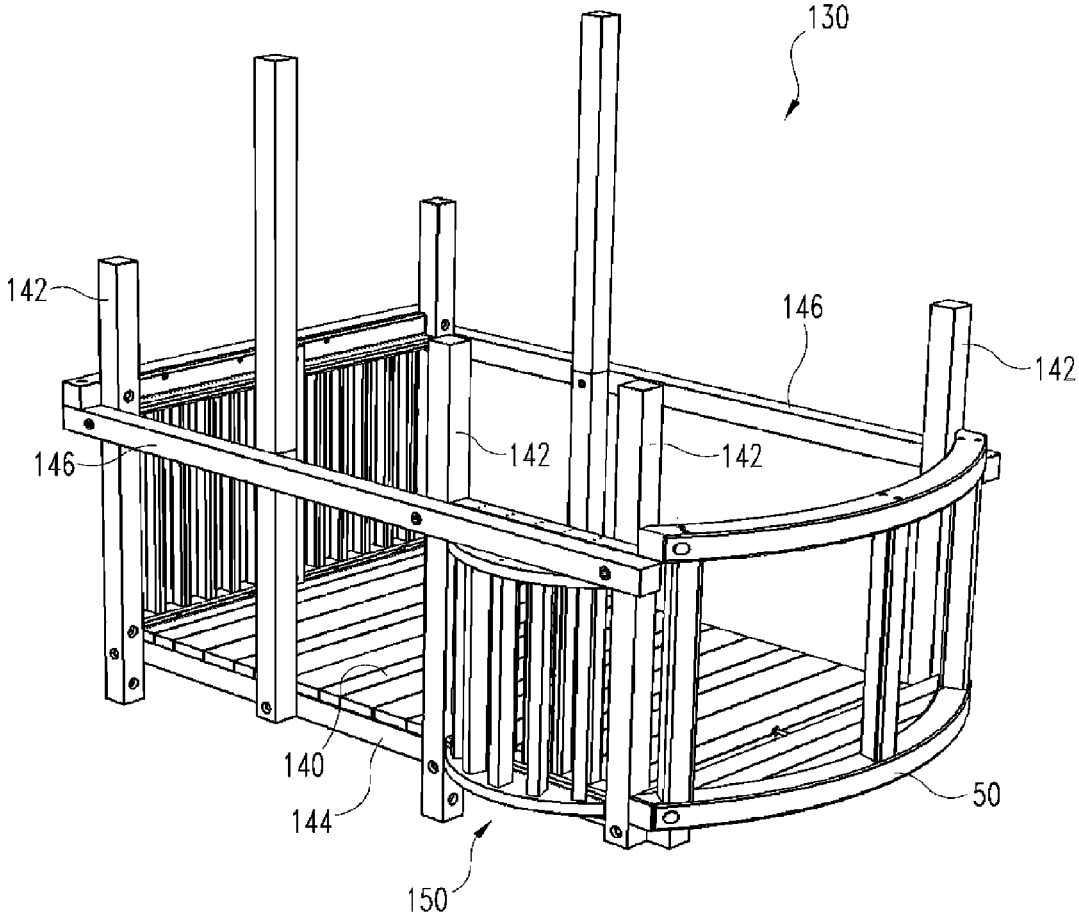
FIG. 15 is a perspective view of the balcony section of the playset of FIG. 12.
Figure 16:
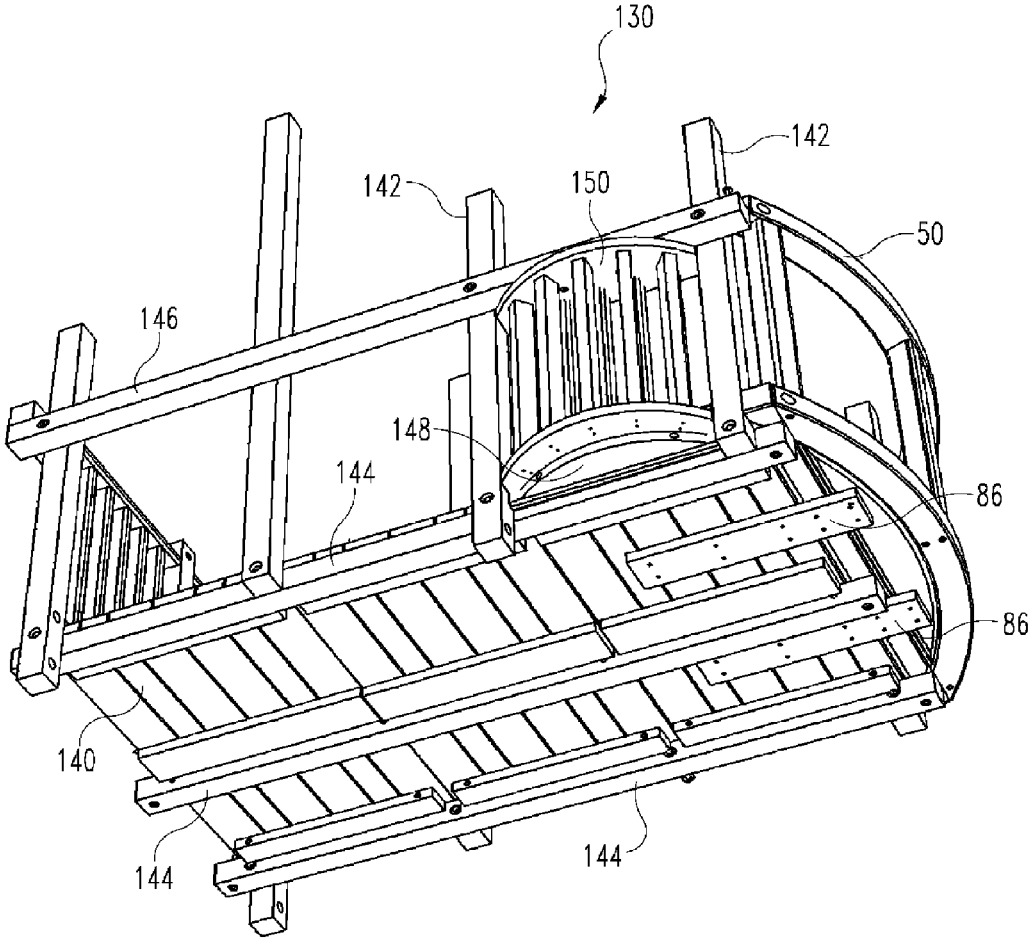
FIG. 16 is an upward view of the balcony section of FIG. 15.
Figure 17:
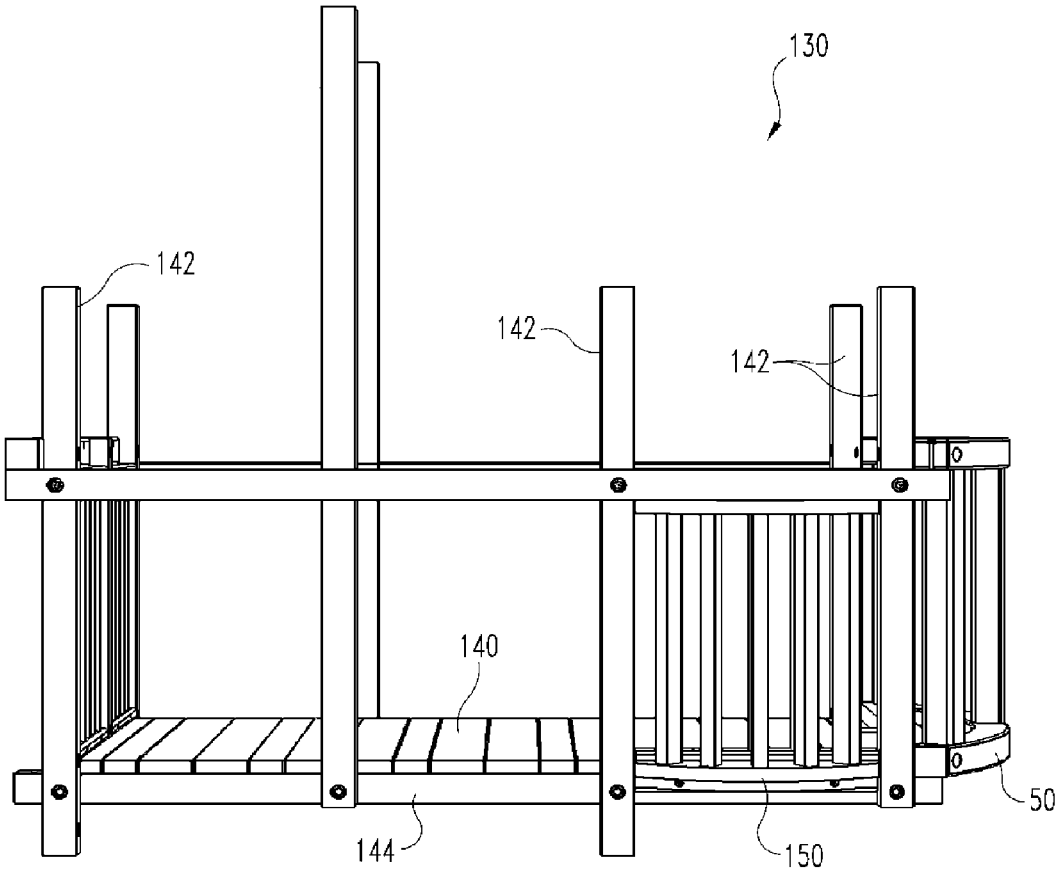
FIG. 17 is a side view of the balcony section of FIG. 15.
Figure 18:
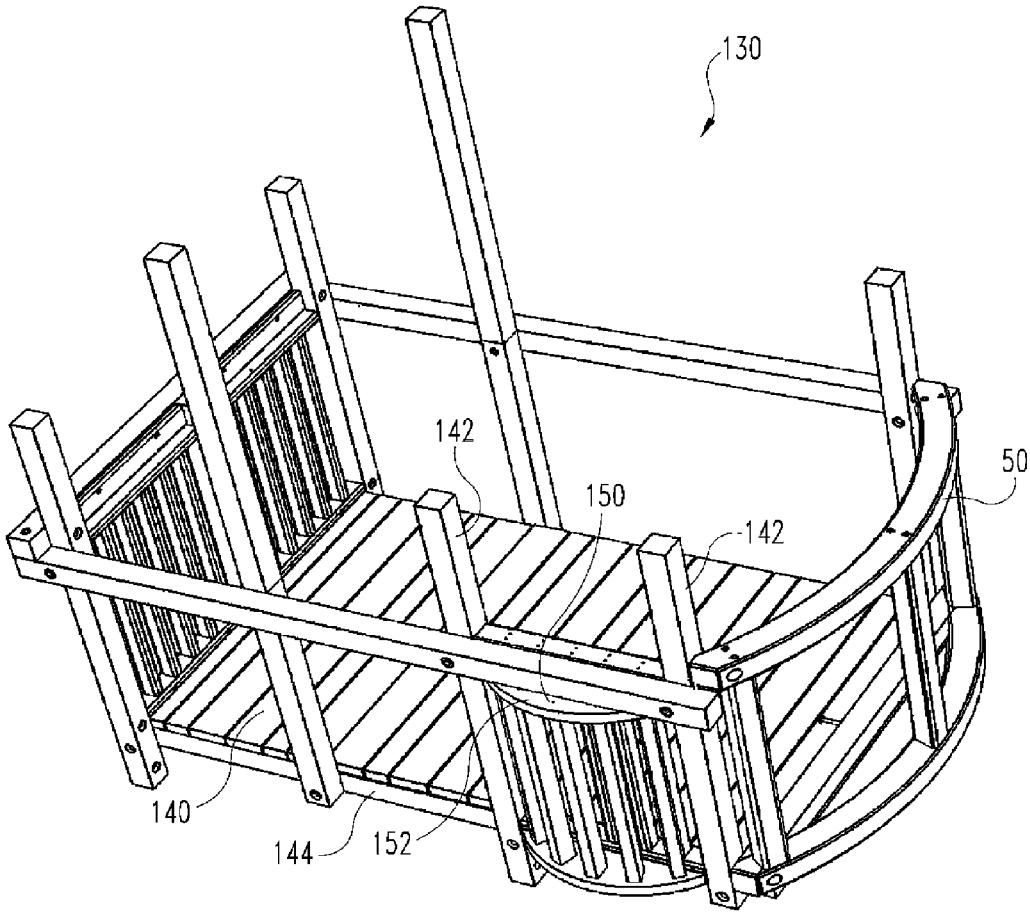
FIG. 18 is a downward perspective view of the balcony section of FIG. 15.
Figure 19:
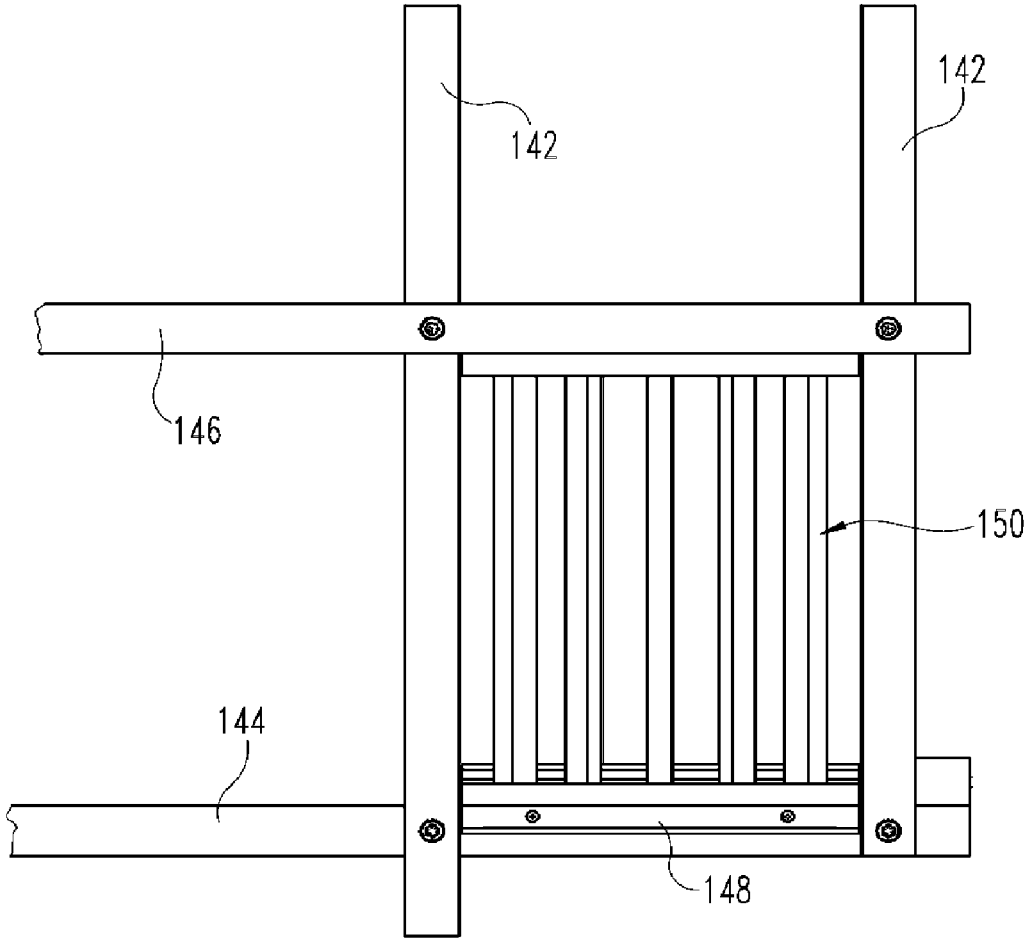
FIG. 19 is a side view of the subpanel section of FIG. 15.
Figure 20:
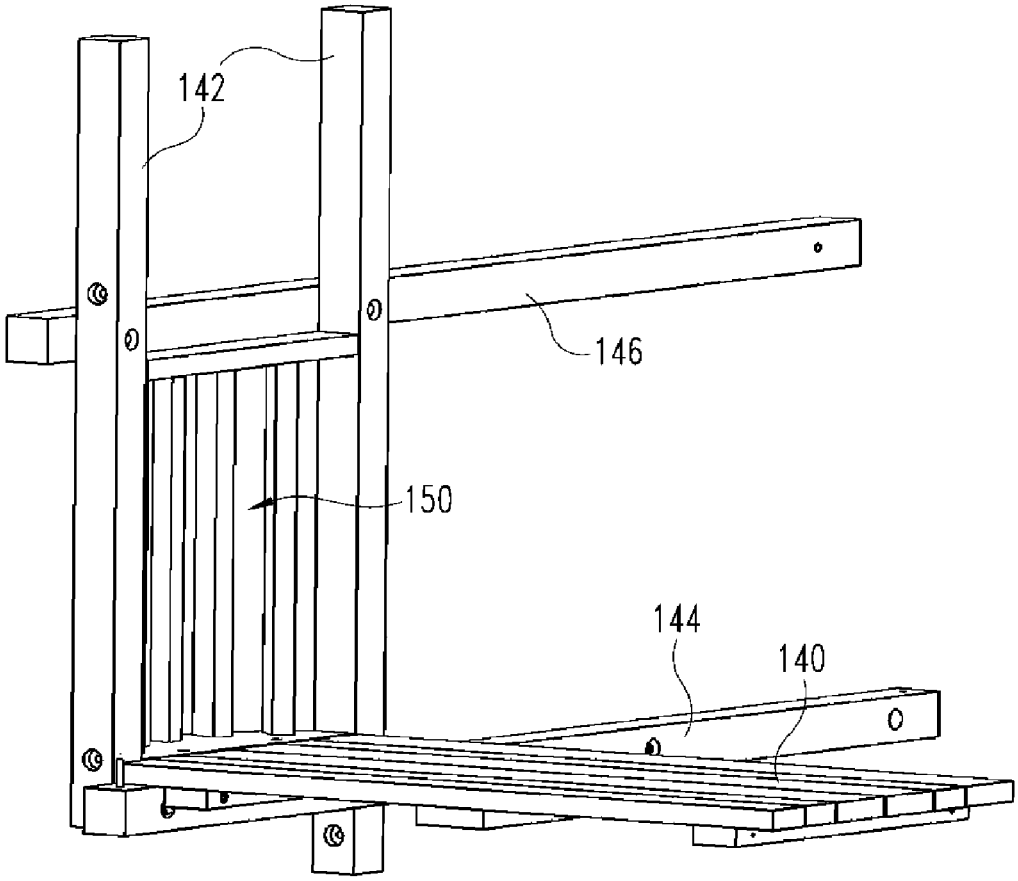
FIG. 20 is a partial outward view of the subpanel section of FIG. 19.
Figure 21:
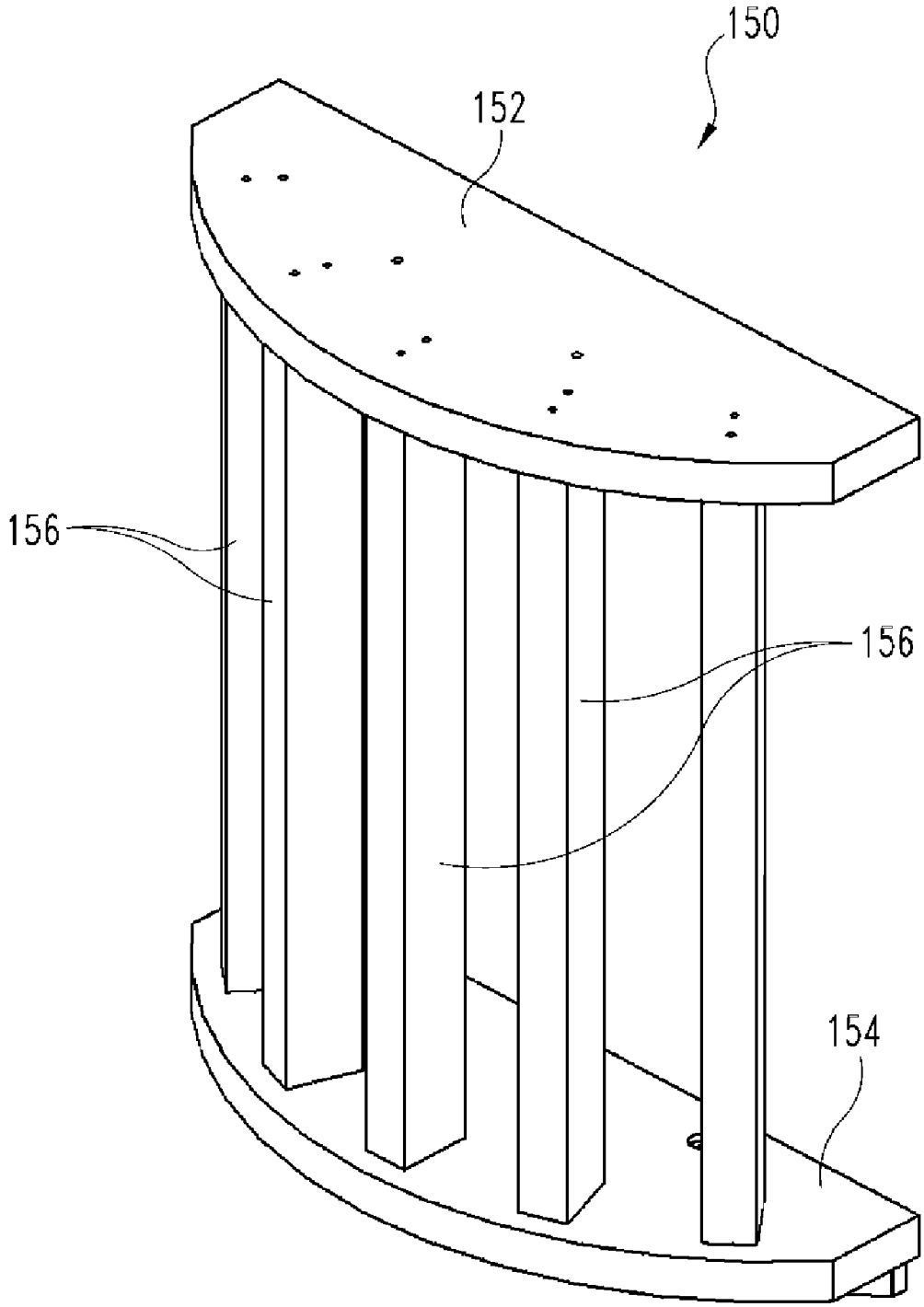
FIG. 21 is a perspective view of the subpanel section of FIG. 19.
Figure 22:
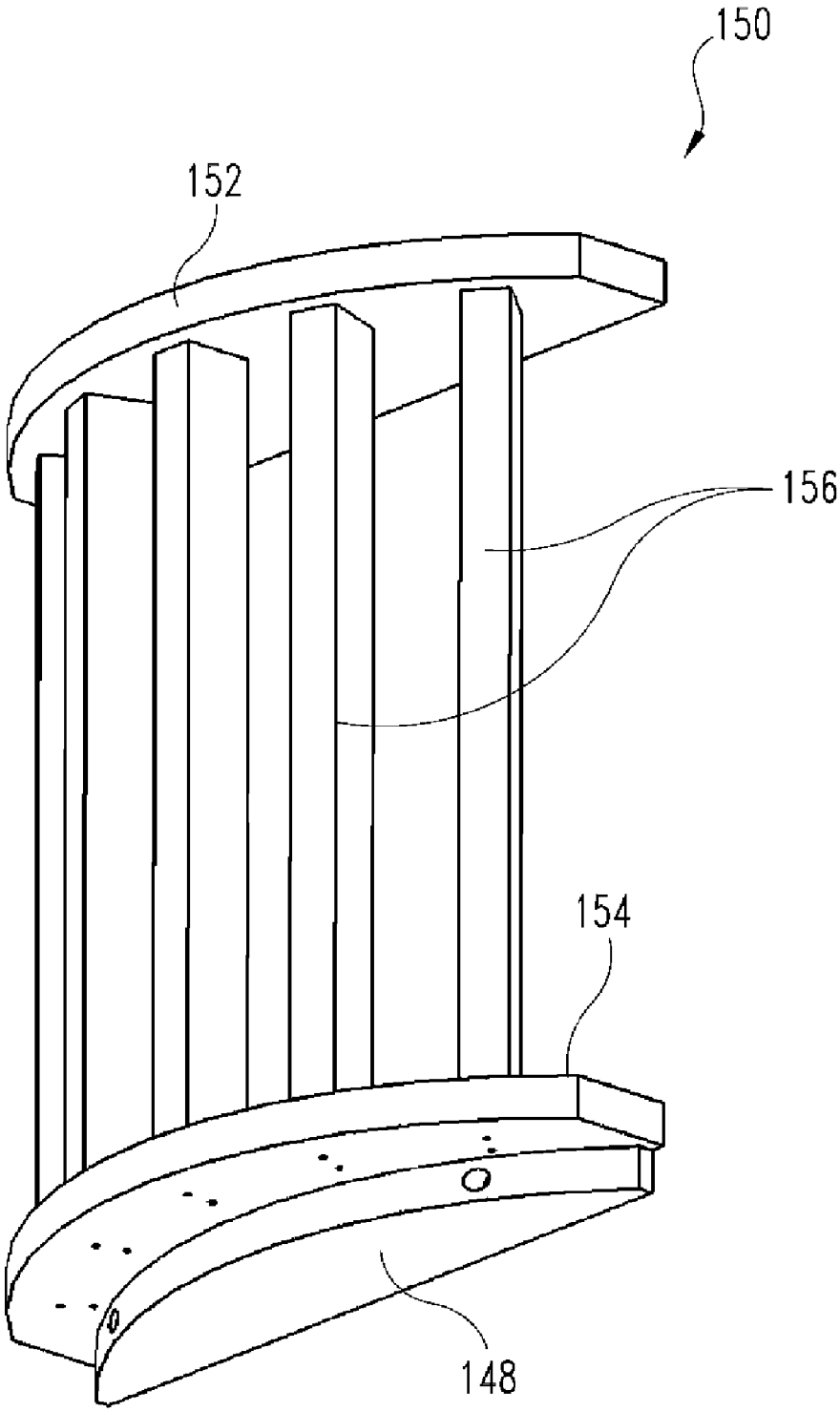
FIG. 22 is an upward view of the subpanel section of FIG. 21.
Figure 23:
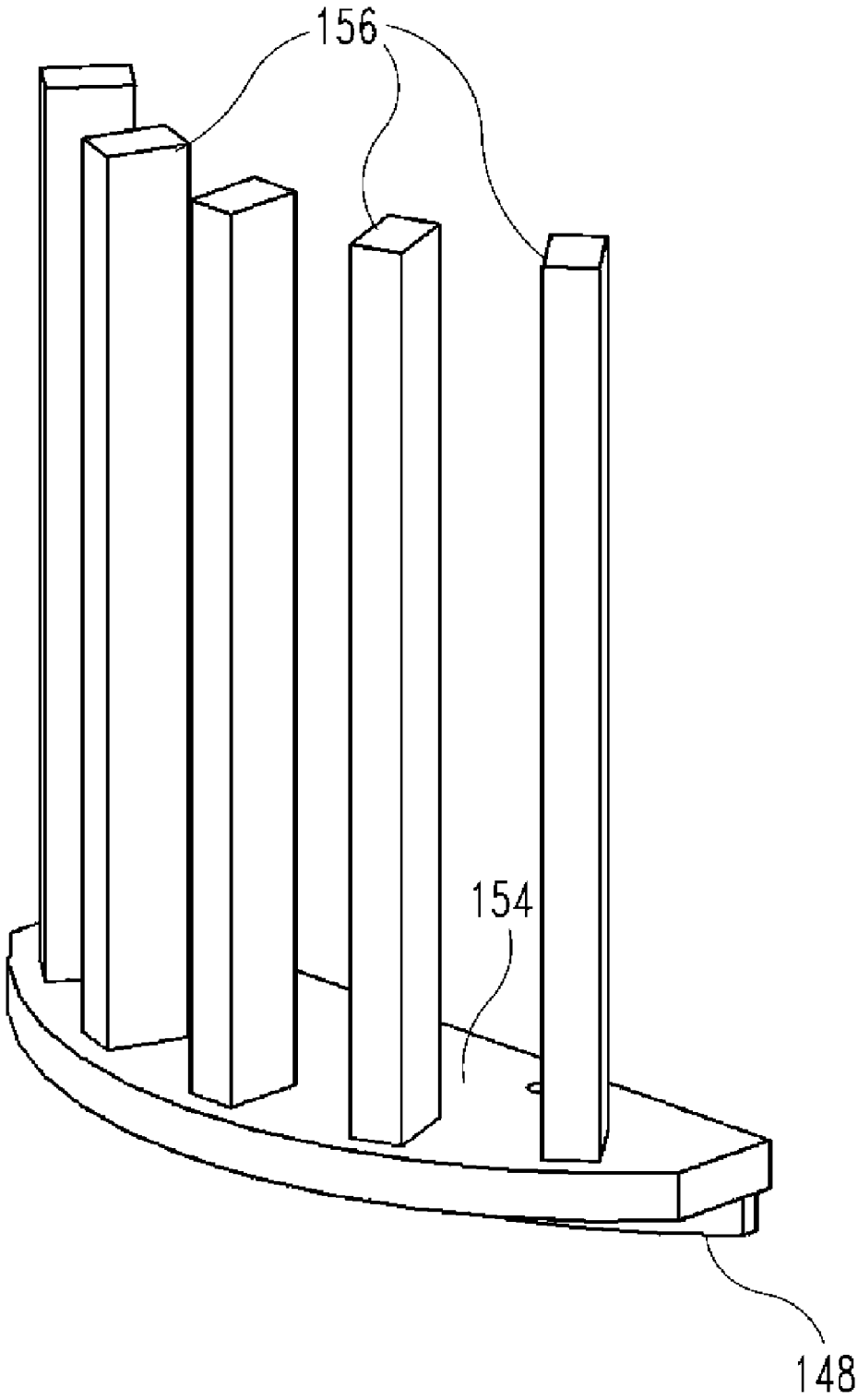
FIG. 23 is a perspective view of the subpanel section of FIG. 21 without the header piece.

In the embodiment illustrated in FIG. 13, and shown further in FIGS. 19-23, subpanel or partial wall portion 150 is curved horizontally outward from a portion of one wall of platform section 130. Protruding subpanel 150 preferably protrudes beyond the floor 140 of the platform section and presents an outer curved or arcuate face similar to balcony section 50. The width of protruding section 150 may be less than the width of the wall section where it is arranged, for example, in FIGS. 13-18 it is illustrated as approximately one-third of the width of a side wall of platform section 130. Various widths with corresponding support and attachment structures can be used as desired by those of skill in the art.

In the example illustrated, protruding section 150 includes a header piece 152, a footer piece 154 and one or more balusters or rungs 156. Preferably, when panel section 150 is arranged on platform section 130, the upper surface of footer piece 154 is flush with the upper surface of the platform section floor 140 to expand the square footage of the platform section. Header piece 152 may have a curved exterior face and a flat interior side as shown, or alternately, could be formed as an arcuate curve along both the inner and outer faces separated by the width of the balusters 156.

Protruding section 150 is preferably sized in height so that footer piece 154 connects to a footer beam of the support frame such as by resting on a shelf or an arcuate ledge piece or shelf 148 formed of or mounted to a lower support beam 144. Protruding panel 150 preferably has a height so that header piece 152 fits beneath a header cross beam or rail 146. As example fasteners, screws or bolts can be used to connect footer piece 154 to shelf piece 148 and screws or bolts can be used to connect header piece 152 to railing piece 146. Alternately, a portion of rail 146 can serve as the header piece for the subpanel with the balusters directly connected to the inside face, outside face or underneath side of the rail.

Protruding panel 50 is illustrated with a face protruding beyond the rail header beam and a footer beam to form an arcuate arrangement of balusters 156 each having a substantially rectangular cross section and radially arranged in an arc corresponding to the outward arc of header piece 152 and footer piece 154. Alternate baluster arrangements include tapered or decoratively profiled balusters or spindles. Alternately, the protruding section face may be formed with one or more plain or decorative panels to form a more solid wall.

In certain embodiments, platform section 130 may be mounted to a footer support beam via an arcuate shelf 148 or a footer piece with an outer arcuate face such as footer piece 154 without using upright elements and optionally with or without an arcuately faced header piece such as 152. In such open style embodiments, the wall portion of the platform section has a protruding floor section with an arcuate face that may allow access to one or more accessories connected to or arranged adjacent the wall opening. In certain embodiments, this allows accessories to extend at an angle from the playset which differs from the perpendicular direction in which such an accessory might normally extend from a flat or straight edge of a polygonal platform. In certain embodiments, the angle of mounting of the accessory can be adjusted as perpendicular to a tangent line selected to an arcuate portion, allowing a mounting angle within a range defined by the curve.

The playset and components herein can be formed of various materials as desired, with example materials being wooden lumber, plastic lumber or metal. Appropriate fasteners such as bolts and nuts, locknuts, washers, screws and nails are used to assemble and connect the components as would be understood by those of skill in the art.

While the disclosure has been illustrated and described in detail in the drawings and foregoing description, the same is to be considered as illustrative and not restrictive in character, it being understood that only the preferred embodiments have been shown and described and that all changes and modifications that come within the spirit of the disclosure are desired to be protected.

What is claimed is:

1. A playset system, comprising:

a playset system including at least one tower section;

at least one platform section supported by said tower section above a support surface, said platform section having four upright framing pieces extending upward to form four corners of a rectangular floor area;

four exterior walls extending between said upright framing pieces and defining an interior area;

at least one of said exterior walls including a straight rail spaced above a straight lower support beam to define the height of the wall and defining at least one subpanel opening; and a subpanel mounted in said subpanel opening, wherein said subpanel protrudes horizontally outward from said exterior wall, said subpanel having a subpanel footer piece, a subpanel header piece, and a plurality of parallel vertical balusters arranged between said header piece and said footer piece and spaced across the width of said subpanel, wherein said subpanel footer piece and said subpanel header piece each have a curved shape along at least a portion of their outermost edges.

2. The playset of claim 1, wherein said subpanel footer piece and said subpanel header piece each protrude horizontally outward from said straight rail and said straight lower support beam.

3. The playset of claim 2, wherein said subpanel footer piece and said subpanel header piece have a curved shape protruding horizontally outward from said straight rail and said straight lower support beam along at least a portion of their outermost edge.

4. The playset of claim 3, wherein said subpanel footer piece and said subpanel header piece are made of wood.

5. The playset of claim 4, wherein said parallel vertical balusters are made of wood.

6. The playset of claim 4, wherein said subpanel header piece comprises a solid surface which fills the entire area between said straight rail and the outermost vertical face of said subpanel header piece in the horizontal plane.

7. The playset of claim 1, wherein at least one of said plurality of vertical balusters is positioned outwardly beyond the outward face of said straight rail and said straight lower support beam.

8. A playset system, comprising:

a wooden playset system including at least one tower section;

at least one platform section supported by said tower section above a support surface, said platform section having four wooden upright framing pieces extending upward to form four corners of a rectangular floor area;

four exterior walls extending between said upright framing pieces and defining an interior area;

at least one of said exterior walls including a straight rail spaced above a straight lower support beam to define the height of the wall and defining at least one subpanel opening; and a subpanel mounted in said subpanel opening, said subpanel having a wooden subpanel footer piece, a wooden subpanel header piece, and a plurality of parallel vertical wooden balusters arranged between said header piece and said footer piece and spaced in a non-linear arrangement across the width of said subpanel, wherein said subpanel footer piece and said subpanel header each protrude horizontally outward from said straight rail and said straight lower support beam.

9. The playset of claim 8, wherein at least one of said plurality of vertical balusters is positioned outward beyond the outward face of said straight rail and said straight lower support beam.

10. The playset of claim 9, wherein the entirety of at least one of said plurality of vertical balusters is positioned outward beyond the outward face of said straight rail and said straight lower support beam.

11. The playset of claim 10, wherein the entirety of at least two of said plurality of vertical balusters is positioned outward beyond the outward face of said straight rail and said straight lower support beam.

12. A playset system, comprising:

a wooden playset system including at least one tower section;

at least one platform section supported by said tower section above a support surface, said platform section having four wooden upright framing pieces extending upward to form four corners of a rectangular floor area;

four exterior walls extending between said upright framing pieces and defining an interior area;

at least one of said exterior walls including a straight rail spaced above a straight lower support beam to define the height of the wall and defining at least one subpanel opening; and a wooden subpanel mounted in said subpanel opening, said subpanel having a wooden subpanel footer piece, a wooden subpanel header piece, and a plurality of parallel vertical balusters arranged between said header piece and said footer piece and spaced across the width of said subpanel, wherein the outer faces of said subpanel footer piece and said subpanel header each have portions which extend horizontally outward beyond the outer face of said straight rail and said straight lower support beam.

13. The playset of claim 12, wherein said subpanel header piece comprises a solid surface which fills the entire area between said straight rail and the outermost vertical face of said subpanel header piece in the horizontal plane.

14. The playset of claim 13, wherein said plurality of vertical balusters are made of wood.

15. The playset of claim 12, wherein at least one of said plurality of vertical balusters is positioned outwardly beyond the outward face of said straight rail and said straight lower support beam.

16. A playset system, comprising:

a wooden playset system including at least one tower section;

at least one platform section supported by said tower section above a support surface, said platform section having four wooden upright framing pieces extending upward to form four corners of a rectangular floor area;

four exterior walls extending between said upright framing pieces and defining an interior area;

at least one of said exterior walls including a straight rail spaced above a straight lower support beam to define the height of the wall and defining at least one subpanel opening; and a wooden subpanel mounted in said subpanel opening, said subpanel having a wooden subpanel footer piece, a wooden subpanel header piece, and a plurality of parallel vertical balusters arranged between said header piece and said footer piece and spaced across the width of said subpanel, wherein the outer faces of said subpanel footer piece and said subpanel header each protrude horizontally outward beyond the outer face of said straight rail and said straight lower support beam and at least one of said plurality of vertical balusters is positioned outwardly beyond the outward face of said subpanel footer piece and said subpanel header.

17. The playset of claim 16, wherein at least two of said plurality of vertical balusters is positioned such that its outward face is outwardly beyond the outward face of said straight rail and said straight lower support beam.

18. The playset of claim 17, wherein each of said plurality of vertical balusters is positioned outwardly beyond the outward face of said straight rail and said straight lower support beam.

19. The playset of claim 16, wherein said parallel vertical balusters are secured between opposing surfaces of said subpanel footer piece and said subpanel header.

20. The playset of claim 19, wherein said parallel vertical balusters are made of wood.

* * * * *